US007614582B2

(12) United States Patent
Häfner

(10) Patent No.: US 7,614,582 B2
(45) **Date of Patent: *Nov. 10, 2009**

(54) CONNECTING SYSTEM

(75) Inventor: Manfred Häfner, Leopoldshöhe (DE)

(73) Assignee: Häfner & Krullmann GmbH, Leopoldshöhe (DE)

( * ) Notice: Subject to any disclaimer, the term of this patent is extended or adjusted under 35 U.S.C. 154(b) by 0 days.

This patent is subject to a terminal disclaimer.

(21) Appl. No.: 11/908,128

(22) PCT Filed: Mar. 8, 2006

(86) PCT No.: PCT/EP2006/002137

§ 371 (c)(1),
(2), (4) Date: Oct. 26, 2007

(87) PCT Pub. No.: WO2006/094789

PCT Pub. Date: Sep. 14, 2006

(65) Prior Publication Data

US 2008/0135676 A1 Jun. 12, 2008

(30) Foreign Application Priority Data

Mar. 9, 2005 (DE) ..... 10 2005 010 708

(51) Int. Cl.
*B65H 75/14* (2006.01)

(52) U.S. Cl. ..... 242/609; 242/609.1; 242/609.3; 242/118.4

(58) Field of Classification Search ..... 242/609, 242/609.1, 609.3, 608.5, 118.4, 118.61
See application file for complete search history.

(56) References Cited

U.S. PATENT DOCUMENTS

| | | | | |
|---|---|---|---|---|
| 3,796,387 | A * | 3/1974 | Zielke | 242/606 |
| 5,593,108 | A * | 1/1997 | Eck et al. | 242/608.5 |
| 5,779,186 | A * | 7/1998 | Bakker et al. | 242/609.1 |
| 5,803,401 | A | 9/1998 | Matsuzoe | |
| 6,089,500 | A * | 7/2000 | Hafner | 242/608.5 |
| 6,182,922 | B1 | 2/2001 | Kazama | |
| 6,343,765 | B1 | 2/2002 | Wen | |
| 2007/0181739 | A1 * | 8/2007 | Derendal | 242/608.5 |
| 2007/0262192 | A1 * | 11/2007 | Derendal | 242/608.5 |

FOREIGN PATENT DOCUMENTS

| | | | |
|---|---|---|---|
| DE | 40 01 250 | A1 | 7/1991 |
| DE | 197 00 185 | A1 | 7/1998 |
| EP | 0 404 043 | A1 | 12/1990 |
| WO | 02/08107 | A1 | 1/2002 |

* cited by examiner

*Primary Examiner*—Sang Kim
(74) *Attorney, Agent, or Firm*—Richard M. Goldberg

(57) ABSTRACT

Connector system for detachably connecting rotationally symmetrical parts, particularly parts of a spool for winding a skein-shaped product, with ring surfaces (22, 24) at the facing front surfaces of the parts to be connected, with locking projections (26, 28, 30, 32, 34) extending from at least one of the ring surfaces (22, 24) in the direction of the other ring surface, and with detent recesses (40, 42, 44, 46) in the ring surface or both other ring surfaces, respectively, for receiving the locking projections to connect the parts in the manner of a bayonet catch by mutual rotation, and spring-loaded tongues (52, 54) are provided in alignment with the respective detent recesses (40, 42, 44, 46), which engage behind the locking projections (26, 28, 30, 32, 34) in the locked position and prevent the connected parts from untwisting into the detached position.

6 Claims, 3 Drawing Sheets

16
22
24
18
34
66
60
62
58
48
46
50
32
62
48
44
60
56
50
36
30
38

CONNECTING SYSTEM

BACKGROUND OF THE INVENTION

The invention relates to a connector system for detachably connecting rotationally symmetrical parts, particularly parts of a spool for winding a skein-shaped product, with ring surfaces at the facing front surfaces of the parts to be connected, with locking projections extending from at least one of the ring surfaces in the direction of the other ring surface, and with detent recesses in the ring surface or both other ring surfaces, respectively, for receiving the locking projections to connect the parts in the manner of a bayonet catch by means of mutual rotation.

Connecting systems which act in various ways based on the principle of a bayonet catch, are disclosed in many embodiments. They are used in spools employed for winding skein-shaped products, e.g. wires or plastic strapping. Spools of this type consist, for example, of a cylindrical or conical spool body and two flange discs at both ends. They can be partially disassembled, for example to reduce the volume during transport, or for the purpose of unwinding the skein-shaped product. Spools will be quoted in the following description by way of examples, but the invention is not, however, limited to the detachable connection of spool parts.

With regard to the state of the art, reference will be made to DE 197 00 185 A1 and DE 40 01 250 A1.

DE 197 00 185 A1 describes, for example, a spool whose body converges conically on both sides from both end flange discs towards the middle, and is divided in the middle so that the two spool parts can be space-savingly stacked if they have to be transported unused. The two spool parts are connected by means of a kind of bayonet catch which allows the two parts to be connected with a certain degree of pretension. The pretension prevents the two spool parts from untwisting and separating, although the risk of such untwisting cannot be entirely eliminated if the spool is handled roughly or subjected to oscillation for long periods of time, during transport, for example.

The invention is therefore based on the task of providing a connector system of the aforementioned type, which can be operated easily and without tools, and which offers a high degree of security against unintentional detachment of the connection.

This task is solved in that, in the case of a connector system of the said type, a spring-loaded tongue is provided in alignment with the respective detent recesses, which engages behind the locking projections in the locked position and prevents the connected parts from untwisting into the detached position.

Hence the connection can only be detached when the spring-loaded tongue is pressed back out of its blocking position. This can be achieved by means of a pressure element, preferably disposed in sliding fashion directly on the ring surface in the vicinity of the detent recess.

Naturally, several locking projections and several detent recesses can be provided on the ring surfaces, and accordingly, spring-loaded tongues can be provided on several detent recesses. It can therefore be expedient to provide pressure elements for all the tongues on a common rotating ring.

The locking projections and detent recesses can be provided on one ring surface or on both ring surfaces, in which case they can take effect crosswise.

The locking projections preferably comprise a relatively narrow stem portion and, on top of said stem portion, a head that is enlarged, in the radial direction at least, and the detent recesses are preferably contrived in a keyhole shape. They correspondingly comprise an entry area for the locking projections that is wider in the radial direction, and, adjoining this in the circumferential direction, a narrower locking section. When the two parts are rotated in opposite directions the locking projections move in the circumferential direction from the entry area into the locking section, behind the lateral edges of which the head engages. In this position, the two parts of the spool are firmly connected.

Further, if the locking projections can be prevented by the spring-loaded tongues from moving out of the locking section into the entry area, all risk of the connection being unintentionally detached is eliminated.

BRIEF DESCRIPTION OF THE DRAWINGS

Preferred examples of embodiments will be described below with reference to the attached drawings

DETAILED DESCRIPTION

Figure 1:
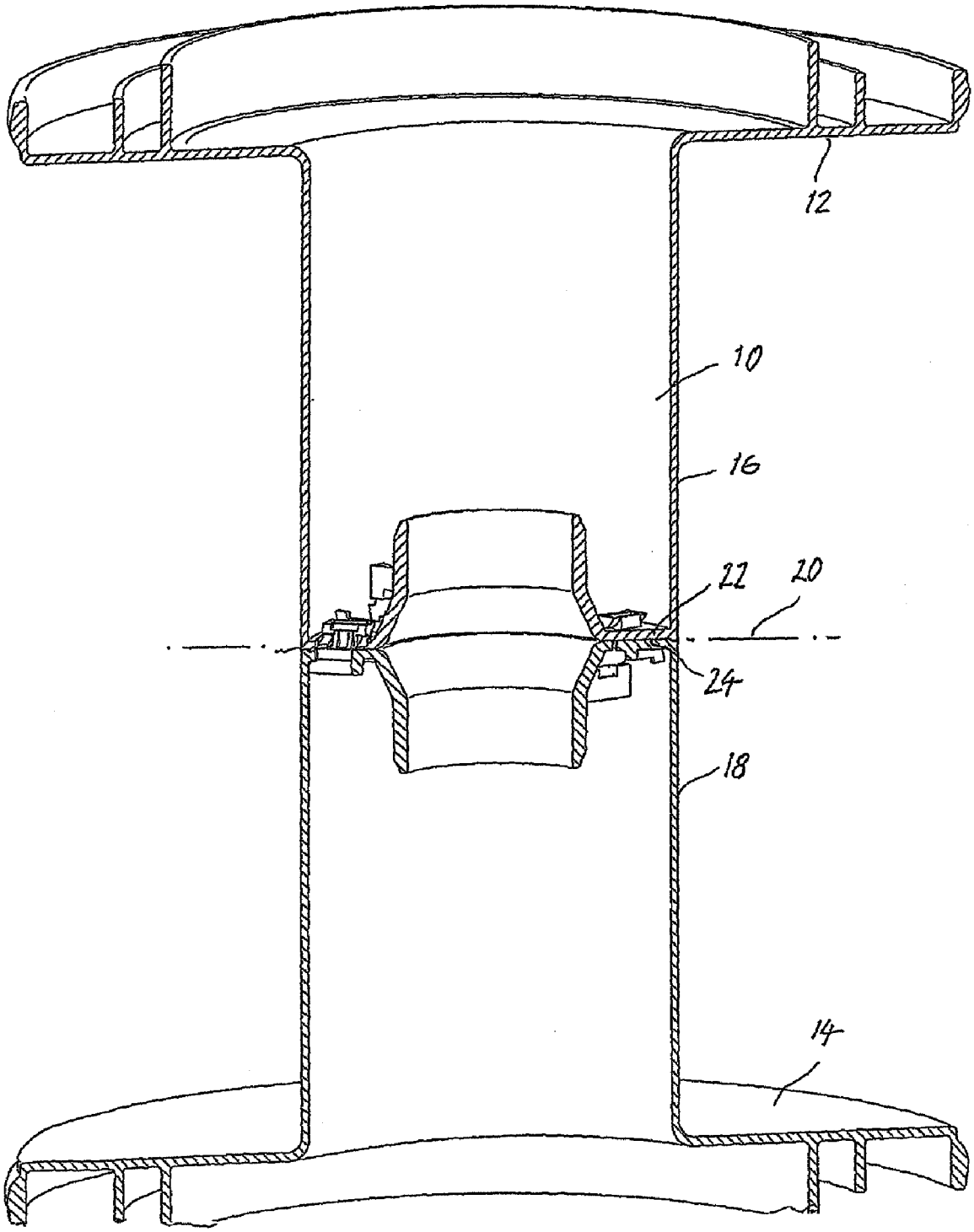
FIG. 1 shows an axial section through an embodiment of a divisible spool.

FIG. 1 shows a spool with a cylindrical body 10, at both ends of which there are flange discs 12, 14. Spool body 10 is divided into two spool parts 16, 18 along a radial plane located approximately in the middle of the axial length of body 10.

Adjoining the radial dividing plane designated as 20, the two hollow-cylindrical spool parts 16, 18 form inwardly abutting ring surfaces 22, 24 provided with the connecting elements of the connector system according to the present invention. These connecting elements will be explained below with reference to FIGS. 2 and 3. With reference to FIG. 1, note also that fully closed surfaces can be provided in place of ring surfaces 22, 24. At the very least, however, these ring surfaces are required for the solution according to the invention.

Finally, the connecting elements disposed on the two ring surfaces 22, 24 will be described.

Figure 2:
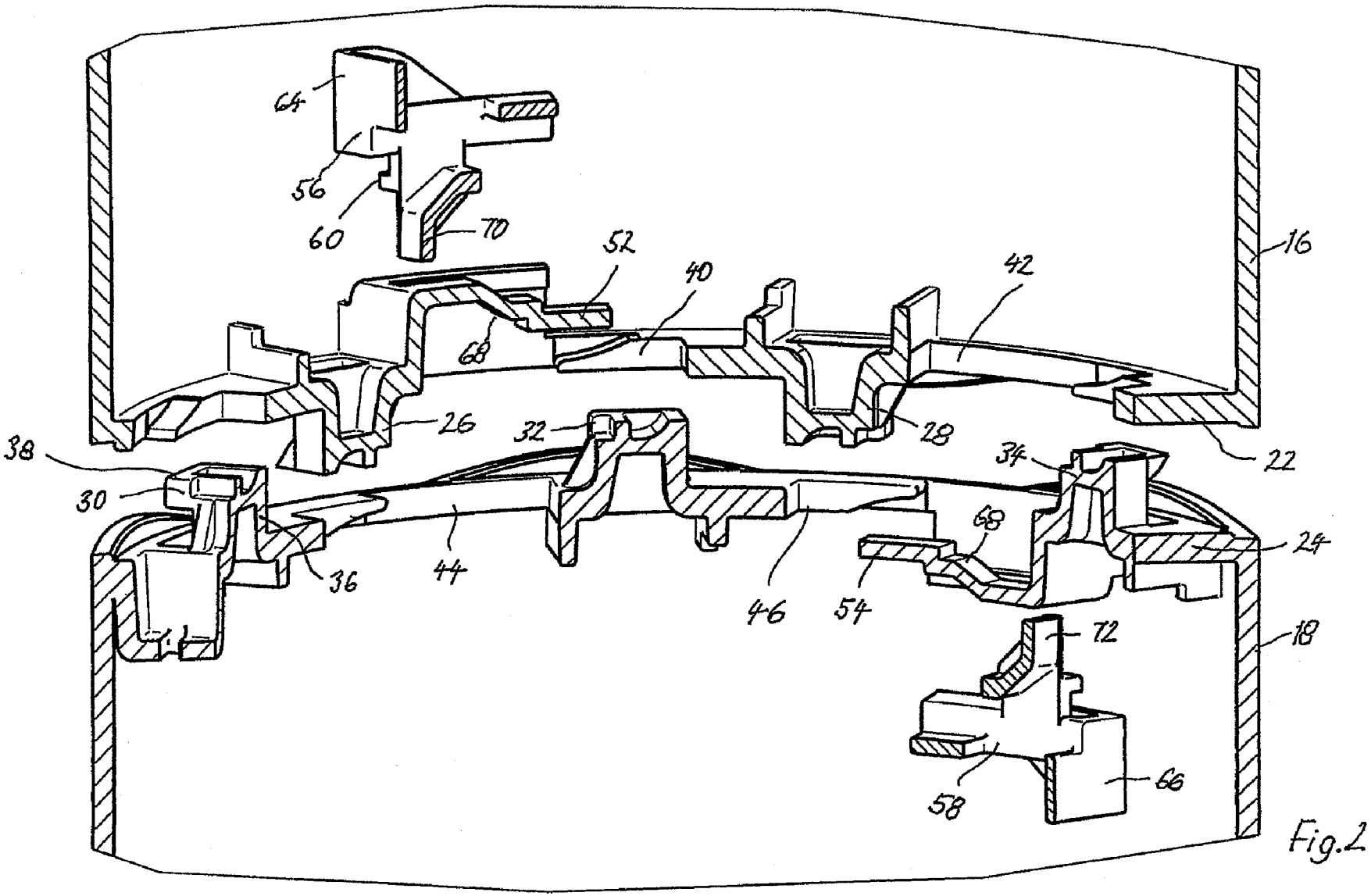
FIG. 2 is a partial sectional view of the connecting portion of the parts to be connected.
Figure 3:
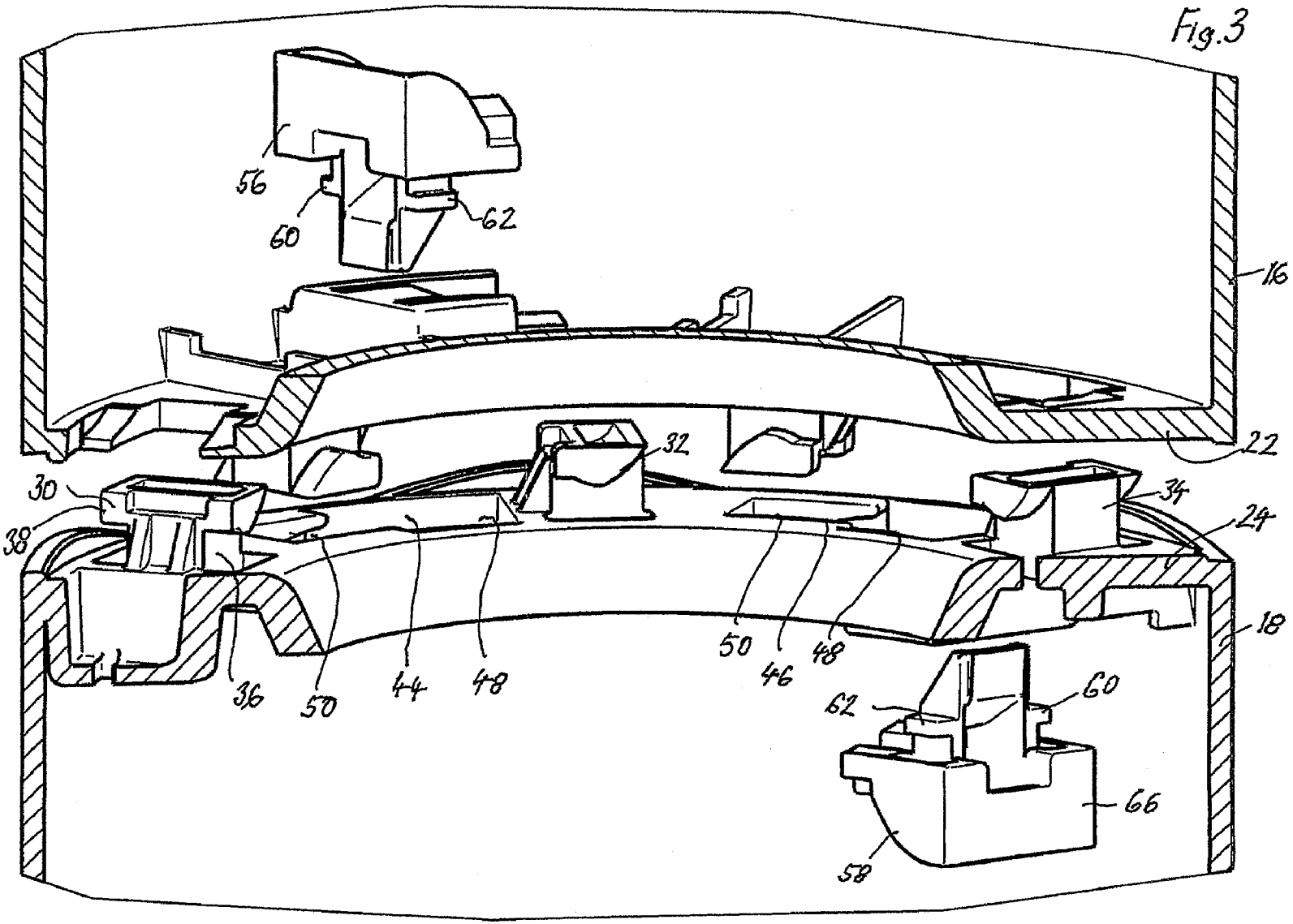
FIG. 3 is largely equivalent to FIG. 2, but shows the connecting portion from another angle.

In FIG. 2, two locking projections 26, 28 are contrived on ring surface 22 of upper spool part 16, and three locking projections 30, 32, 34 are provided on ring surface 24 of the lower spool part 18. These locking projections 26, 28, 30, 32, 34 each point towards the opposite ring surface. As can be seen by the example of locking projection 30 in FIG. 2, the locking projections comprise a narrower stem portion 36 and, at the end of the stem portion, a head 38 which overhangs in the radial direction. Detent recesses 40, 42 and 44, 46 are also provided in both ring surfaces. Detent recesses 44, 46 in lower ring surface 24 are particularly clearly illustrated in FIG. 3.

Detent recesses 44, 46 have a largely keyhole-shaped contour. That means they comprise a wider entry area 48 and, adjoining in the circumferential direction, a narrower locking section 50 in the radial direction. To connect the two parts, the locking projections are guided into the entry area 48 of the detent recesses, into which the locking projections can enter, even with their enlarged head 38. The two parts are then rotated in opposite directions. This moves locking projections 26, 28 in the detent recesses into the narrower locking sections 50, inside which the heads 38 of the locking projections engage behind ring surface 24, so that the two parts cannot be separated in the axial direction.

To ensure that the two spool parts 16, 18 cannot unintentionally untwist from the connected position and therefore release the connection, spring-loaded tongues 52, 54 are provided which are bent slightly upwards by the locking projections upon entering into the narrower locking sections 50, but then spring back behind the locking projections, thereby retaining the locking projections in the locking sections of the detent recesses. As the locking projections enter locking sections 50, the spring-loaded tongue 52 on the upper ring surface 22 is bent upwards and the spring-loaded tongue 54 on the lower ring surface 24 is bent downwards. After the heads 38 of the locking projections pass, they then spring back in the opposite direction.

Pressure elements 56, 58 are provided to break the connection. Pressure elements 56, 58 are contrived on ring surfaces 22, 24 such that they can be moved in the circumferential direction. They are provided with guide bars 60, 62, which facilitate this displacement in conjunction with corresponding, non-illustrated elements on ring surfaces 22, 24. An upwardly and downwardly projecting lip 64, 66 on the upper and lower pressure elements 56, 58 shown in FIGS. 2 and 3 grips the spring-loaded tongues 52, 54 from below or above, and, when moved along a sloping surface of the spring-loaded tongues, presses them out of the position in which they retain the locking projections. This releases the bayonet catch and the two parts can be untwisted. Another lip 70, 72 ensures that the pressure elements are returned to their starting position when the locking projections are moved out of locking sections 50 into entry areas 48 when the two spool parts are untwisted.

The two spool parts can both be made from plastic. In this case, the spring-loaded tongues 52 can be injection-moulded directly onto the edge of the detent recesses.

The spool body 10 which forms the winding core for the windable product may have openings through which the windable product can be treated from inside the spool body. Heated air for drying the windable product can be fed through such openings, for example. Treatment with gases or liquids is also feasible.

The invention claimed is:

1. A connector system for detachably connecting rotationally symmetrical parts, comprising:

ring surfaces at facing front surfaces of the parts to be connected, locking projections extending from at least one of the ring surfaces in the direction of the other ring surface, detent recesses in at least another one of the ring surfaces, respectively, for receiving the locking projections to connect the parts in the manner of a bayonet catch by mutual rotation, spring-loaded tongues in alignment with respective detent recesses, and which engage behind the locking projections in a locked position and prevent the connected parts from untwisting into a detached position, and sliding pressure elements, which, in one of the positions which they occupy, press the spring-loaded tongues out of engagement with the locking projections, and the pressure elements are contrived on a ring which is rotatably mounted on a rear side of the ring surfaces of the parts.

2. The connector system of claim 1, wherein:

the locking projections have projecting stem portions and, at ends thereof, radially overhanging heads, and the detent recesses are keyhole-shaped with an enlarged entry area into which the locking projections can be moved, and, bordering on said entry area in the circumferential direction, a narrower locking section behind which the head of said locking projection engages in the locked position of the parts.

3. The connector system of claim 1, wherein rearward surfaces of the ring surface have sloping surfaces in a region of the locking area of detent recesses.

4. The connector system of claim 3, wherein the spring-loaded tongues are attached to edges of the detent recesses.

5. The connector system of claim 3, wherein the spring-loaded tongues are injection-molded onto the edges in plastic.

6. The connector system of claim 1, wherein the rotationally symmetrical parts are parts of a spool for winding a skein-shaped product.

* * * * *